US006311636B1

(12) United States Patent
Degenkamp

(10) Patent No.: US 6,311,636 B1
(45) Date of Patent: Nov. 6, 2001

(54) ANCHOR AND METHOD OF UNCOUPLING FOR SUCH ANCHOR

(75) Inventor: Gijsbertus Degenkamp, Ea Voorburg (NL)

(73) Assignee: Octrooibureau Vrisendorp & Gaade (NL)

( * ) Notice: Subject to any disclaimer, the term of this patent is extended or adjusted under 35 U.S.C. 154(b) by 0 days.

(21) Appl. No.: 09/367,761

(22) PCT Filed: Feb. 20, 1998

(86) PCT No.: PCT/NL98/00102

§ 371 Date: Aug. 19, 1999

§ 102(e) Date: Aug. 19, 1999

(87) PCT Pub. No.: WO98/36963

PCT Pub. Date: Aug. 27, 1998

(30) Foreign Application Priority Data

Feb. 24, 1997 (NL) ..... 1005353

(51) Int. Cl.[7] ..... B63B 21/40
(52) U.S. Cl. ..... 114/297; 114/301
(58) Field of Search ..... 114/294, 301, 114/297, 298, 299

(56) References Cited

U.S. PATENT DOCUMENTS

| | | | | |
|---|---|---|---|---|
| 2,007,667 | | 7/1935 | Stubbs | 114/208 |
| 2,796,844 | * | 6/1957 | March | 114/299 |
| 3,067,715 | * | 12/1962 | Billups | 114/298 |
| 3,130,703 | * | 4/1964 | Thompson | 114/294 |
| 3,450,088 | | 6/1969 | Guier | 114/208 |
| 3,964,421 | | 6/1976 | Van den Haak | 114/208 R |
| 4,230,062 | | 10/1980 | Fornasiero | 114/297 |
| 4,433,635 | | 2/1984 | Takahashi | 114/301 |

FOREIGN PATENT DOCUMENTS

| | | | | |
|---|---|---|---|---|
| 0 297 703 | | 6/1987 | (EP) | B63B/21/22 |
| 2644748 | | 3/1989 | (FR) | B63B/21/44 |
| 60067289 | | 4/1983 | (JP) | B63B/21/22 |
| 60-67289 | * | 4/1985 | (JP) . | |
| 03208791 | | 11/1991 | (JP) | B63B/21/22 |
| WO93/03958 | | 3/1993 | (WO) | B63B/21/22 |
| WO93/11028 | | 6/1993 | (WO) | B63B/21/26 |
| WO94/12386 | | 6/1994 | (WO) | B63B/21/40 |
| WO96/39324 | | 12/1996 | (WO) | B63B/21/44 |

OTHER PUBLICATIONS

International Search Report for PCT/NL98/00102, dated Jun. 16, 1998.

* cited by examiner

*Primary Examiner*—Sherman Basinger
(74) *Attorney, Agent, or Firm*—Williams, Morgan & Amerson

(57) ABSTRACT

An anchor has a fluke with a longitudinal axis that extends from the rear end of the fluke to its front end. A connection member couples the fluke with the lower end of an anchor line. The connection member comprises an anchor shank and at least one coupling with two cooperating coupling members. The first coupling member is situated on the fluke side of the coupling and is directly or indirectly connected to the fluke in order to follow its movement. The second coupling member is situated on the anchor line side of the coupling and is directly or indirectly connected to the anchor line. An operation member is activated by swinging the anchor line held taut in order to change its angle with respect to the longitudinal axis of the fluke and then to mutually displace the first and second coupling member from a coupling position to a position in which the second coupling member is released or emerges from coupling engagement with the first coupling member. The second coupling member comprises a coupling hook that can be released by means of manipulation of the anchor line.

34 Claims, 5 Drawing Sheets

ANCHOR AND METHOD OF UNCOUPLING FOR SUCH ANCHOR

BACKGROUND OF THE INVENTION

1. Field of the Invention

The invention relates to an anchor with a fluke and a shank, which shank can be rigid or composed of threads, and connected to an anchor line at the upper end.

2. Description of the Related Art

Such anchors are used for mooring floating objects with respect to a water bottom, such as semi-submersibles used in the exploration and exploitation of sea-bottoms.

At installation, the anchors are lowered on the water bottom and then by exerting a pulling force on the anchor line which is connected to the upper end of the shank, pulled in the ground until the anchor is sufficiently far penetrated in there for supplying the required holding power. Said anchor line, up till then used as installation line, can, if so desired, be used for connecting the object and the anchor.

For certain anchoring systems, such as so-called vertical anchoring systems, it is desirable that the mooring or load lines exert a force on the fluke which is perpendicular to the fluke as much as possible and oriented through the surface centre of gravity of the fluke. This can be realized by moving the point of engagement of the installation line on the shank to a place further rearwards on the shank, or by swinging the shank in relation to the fluke. Alternatively an extra load line can be made use of, which line is attached to the anchor on the desired place beforehand, for instance on the fluke at the location of its surface centre of gravity. Examples of such solutions have been described in applicant's international patent applications WO 93/03958 published on Mar. 4, 1993 and WO 94/12386 published on Jun. 9, 1994, the contents of which should be considered inserted herein. International patent applications WO 93/11028 published on Mar. 10, 1993 and WO 96/39324 published on Dec. 12, 1996 can also be referred to, from which anchors are known of which the angle between the shank and the fluke can be altered. In one embodiment this is realized by having the shank consist of two parts, one part extending obliquely to the fore being connected to the installation line and the other, upright part being connected to a (vertical) load line. By pulling the load line a pin breaks resulting in an uncoupling mechanism for the connection between the oblique shank part and the fluke being released. In another embodiment there is a shank, which, with the help of a removable wedge which is clamped between the shank and the fluke, is initially secured in an oblique position. By pulling an extra pulling line the bolt breaks after which a bar provided with a wedge at its bottom end can be slid upwards along the shank in order to lift the wedge, after which the shank can be turned upright. In yet another embodiment the angle is enlarged by swing-pulling the shank from the installation position to a vertical position with the help of the anchor line, by swing-pulling the shank and having a connection between the shank and the fluke fail therewith.

It can also be desired to retrieve the installation line after having pulled an anchor into the ground, possibly together with the shank. For connecting (the rest) of the anchor with the object, an extra anchor line has then already been attached to the fluke or with the shank (when it remains connected to the fluke). The connection between the installation line and the shank or either the connection between the shank and the fluke can be adapted to that end in order to fail at a certain pulling force. Alternatively the connection shank-fluke can be remotely operable for uncoupling, for instance with an extra pulling line. Examples of anchors which have been adapted to that end have been described in the aforementioned international patent application PCT/NL92/00144.

It can furthermore be desirable to alter the angle between the shank and the fluke in order to be able to pull the anchor, at least the fluke, out of the ground to be able to use the (valuable) anchor again. From the international patent application PCT/NL92/00144 an anchor is known of which the shank is connected to the fluke on two locations spaced apart in longitudinal direction of the fluke, one of the connections being remotely detachable, for instance with an extra pulling line or in an acoustic manner, and the other, preferably foremost connection is a hinge. By releasing the connection mentioned first the fluke will only be connected to the fluke at the location of the hinge connection, wherein the fluke can direct itself in an orientation of the lowest resistance when pulling out the anchor. In one embodiment the connection mentioned first is also adjustable, because of which the angle between the shank and the fluke can be enlarged in order to be able to deploy the anchor in the aforementioned vertical anchoring systems.

For all these conversions it is necessary to have a part fail before the connection concerned can be uncoupled and/or special aids, such as pulling lines, acoustic means and hydraulic means are necessary. In this way, on the one hand, there is the risk that the connection concerned releases at an unforseen exceeding of the failure limit of the part (long) before such is desired and the anchor has to be hauled in again in order to install it again or that a future possibility of conversion has to be given up. If one would want to avoid this risk—if at all possible—one would have to manoeuvre the anchor very carefully.

On the other hand the aids mentioned make the anchor expensive and prone to damage and therefore sensitive to disturbance regarding the conversion function.

An objective of the invention is to provide an anchor in which in a simple and reliable way, at the desired moment, one of the types of conversions mentioned, from the installation stage to the user stage or from the user stage to the hauling-in stage, can take place. Furthermore it is an objective of the invention to provide a method for this.

SUMMARY OF THE INVENTION

To that end the invention provides an anchor with a fluke with a longitudinal axis which extends from the rear end of the fluke to its front end and with connection means for connecting the fluke with the lower end of an anchor line, which connection means comprise an anchor shank, the connection means comprising at least one coupling with two cooperating coupling members, the first of which being situated on the fluke side of the coupling and being directly or indirectly connected to the fluke in order to follow its movement and the second being situated on the anchor line side of the coupling and being directly or indirectly connected to the anchor line, the anchor furthermore comprising operation means for the coupling which means are activated by swinging the anchor line held taut in order to change its angle with respect to the longitudinal axis of the fluke and then to mutually displace the first and second coupling member from a coupling position to a position in which the second coupling member is released or emerges from coupling engagement with the first coupling member, the second coupling member comprising a coupling hook which can be released by means of manipulation of the anchor line.

In the anchor according to the invention the connection to be uncoupled can be released in a simple way and only at will by swinging the anchor line, which can either be an installation line or a load line.

Preferably the coupling is adapted such, that at a further pulling of that same anchor line, so in a smooth continuous movement, both coupling members are removed entirely from one another and the parts of the anchor which are connected with them, respectively, are brought at a distance from one another.

Preferably the operation means are adapted for having the second coupling member pivoted from the coupling position to the release position. In this way the turning movement of the anchor line can be efficiently used for uncoupling, without complicated transfer mechanisms being necessary.

In a further embodiment of this the first coupling member comprises a pin about which a coupling hook engages, the operation means being adapted for having the hook pivoted about an axis, which is parallel to and at a distance from the pin. Such a connection which can be uncoupled is very simple in construction and action and can be applied on different locations in the anchor without complicated additional provisions for it.

The operation means then preferably comprise a first stopping face which, at least as long as the hook and the pin are coupled to one another, is stationary with respect to the pin as well as a second stopping face on the hook integrated therewith, the first stopping face forming a limitation for the displacement of the second stopping face at pivoting the hook about the pin and therewith forming a fulcrum for the hook.

The second stopping face preferably is situated at the most 180° in circumferential direction of the hook spaced from the end of the hook to facilitate the release from the hook.

Preferably the pin is provided with a flattening at the side of the pin which is facing away from the hook opening, to further the last stage of the release.

The coupling according to the invention can advantageously be applied to effect an enlargement of the angle between the two portions of the anchor. In that case the connection means comprise a second permanent, latently present connection, between the parts of the anchor connected by both coupling members, which connection extends parallel to the coupling formed by the coupling members, and becomes active after releasing the coupling.

Said connection may be a cable or chain, or a rigid element, which can be extended or folded out.

In the latter case, in case of a hook-shaped second coupling member, this hook may be pivotably though permanently attached to an end of an elongated, rigid intermediate member by means of a second pin, which member is pivotably connected to a part of the anchor which forms a rigid whole with the pin, at the other end by means of a third pin, the pin being situated between the second and the third pivot pin in the coupling position.

In a possible further development of this the intermediate member comprises a longitudinal groove which is concentrical with respect to the pin and in which the second pin is able to slide until abutment, the abutment with the second pin subsequently forming a fulcrum for the hook.

In another possible further development the second pin is fixedly connected to the intermediate member and the hook pivots about the second pin at uncoupling.

BRIEF DESCRIPTION OF THE DRAWINGS

Further advantageous embodiments of the anchor and the method according to the invention are subject of the claims and of the description of a number of the examples shown in the attached drawings following hereafter.

DETAILED DESCRIPTION OF SPECIFIC EMBODIMENTS

Figure 1A:
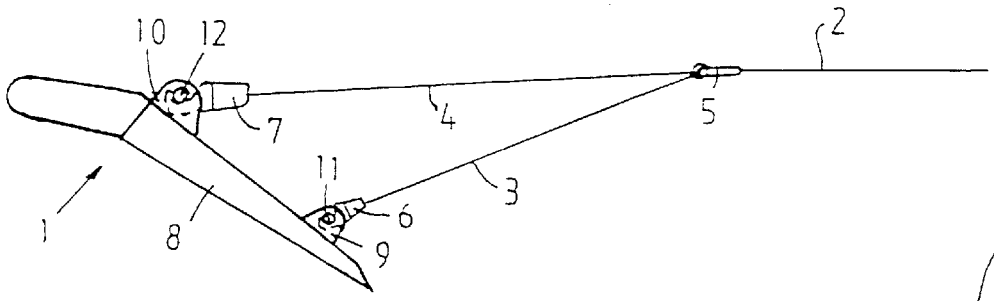
FIGS. 1A–D a first exemplary embodiment of an anchor according to the invention in consecutive stages.
Figure 1B:
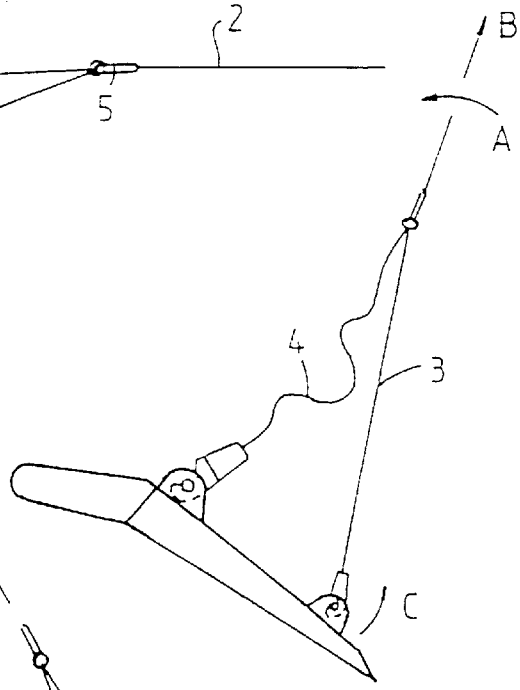
Figure 1C:
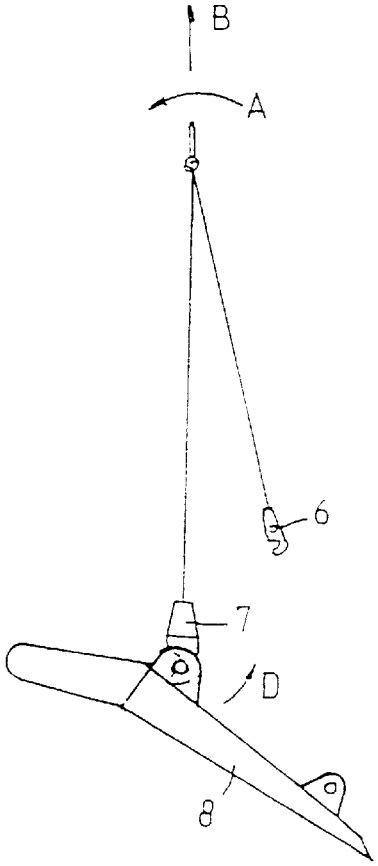

In the FIGS. 1A–D the anchor 1 comprises a fluke 8, on which fixed points of suspension or supports 9 and 10 have been attached, each of which consisting of two upright plates between which pins 11 and 12, respectively, have been attached. It will be understood that two or more supports 9 and two or more supports 10 are present. Each of these supports forms a point of attachment for the lower ends or sockets of the shank wires 3 and 4, which come together at the top at the location of shackle 5, on which the lower end of an anchor line 2 has been attached. Hook-shaped attachments 6 and 7 have been applied onto the lower ends of the shank wires 3 and 4 of which attachments the hooks exactly fit the aforementioned pins 11 and 12. In the situation shown in FIG. 1A the hooks 6 and 7 are confined on the pins 11 and 12, as a result of appropriate design of the hooks and the supports. This will be further gone into in the discussion of the FIGS. 2A–E.

In FIG. 1A the position is shown at the final stage of having the anchor 1 penetrate. It is often desired to be able to use the anchor line 2 used for the installation, again. For this anchor line is not always suitable for use during the actual anchoring or is too expensive for that. It will then be advantageous if the fluke 8 is attached to the object to be anchored with another anchor line, the load line or mooring line, for instance in a vertical anchoring system such as is discussed in the International patent applications mentioned in the permeable. In these figures an attachment for such a load line is not shown, but it will be understood that it will then be present.

Figure 1D:
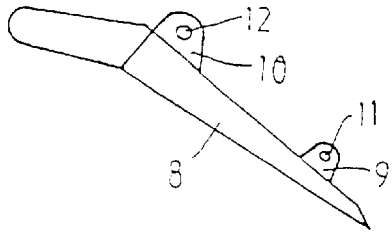

This concerns winning back the installation line 2 in an easy way, with shank wires 3, 4 with it as well. To that end the vessel with which the installation line 2 is connected is sailed to the left as seen in the drawing, because of which line 2, while pulling it taut in the direction B, swings in the direction A. As a result the shank wires 4 will slacken and the shank wires 3 remain taut. The foremost hooks 6 will pivot in the direction C. At a certain moment (see FIGS. 2A–E) the hook 6 will have been urged off the pin 11 and be released, after which, at continued pulling in the direction B and continued swinging in the direction A the shank wires 4 will tauten. At continued swinging in the direction A the same procedure will now follow for the hooks 7 with respect to the pin 12, until the situation shown in FIG. 1D is reached and both shank wires 3 and 4 are loose from the fluke 8.

In the FIGS. 2A–E it can be seen how the hooks 6 get loose. The hook 6 shown here is still coupled to the support 9 with the pin 11 in FIG. 1A. As can be seen in the cross section of FIG. 2F, the support 9 is formed like an upright plate with a hole 16, in which the pin 11 has been inserted. On the hook 6 plates 6*a,* 6*b* have been welded on both sides, which plate serve to make sure that the pin 11 cannot be released. Moreover the plates 6*a,* 6*b* ensure a strengthening of the hook 6, so that the pulling forces can be transferred without deformation of the hook during installation.

Figure 2A:
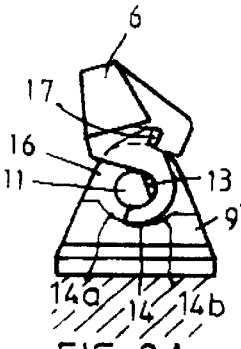
FIGS. 2A–G an exemplary embodiment of a coupling of the anchor according to the invention, in consecutive stages in cross section, as well as an alternative embodiment.
Figure 2B:
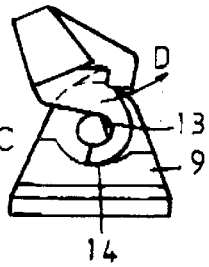
Figure 2C:
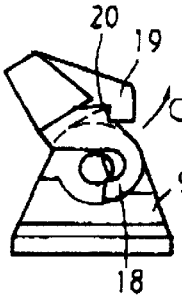
Figure 2D:
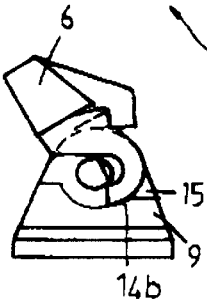
Figure 2E:
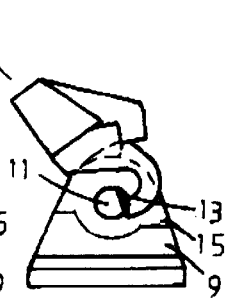

Below the pin 11 there is a bottom 14 (FIG. 2A), which is circular and has a curve in the portion 14*a,* the confinement portion, which curve corresponds to one which is concentric with regard to the central axis of the pin 11 and a portion 14*b* which diverges to the outside with respect to the confinement portion. At the right hand end the portion 14*b* merges into a horizontal plane 15, which slopes out of there. The pin 11 is furthermore provided with a bevel 13 at the release side for the hook. At the upper end the plate 9 is provided with a cam 17, which is situated in a same vertical plane as the cam 19 formed within the hook 6 (not shown in FIG. 2F). At pivoting in the direction C of the hook 6 the cams 17 and 19 will, as can be seen in FIG. 2B, abut one another in order to form a fulcrum 20 for the hook at further pivoting (FIG. 2C) in C', which fulcrum is at a distance from the central axis of the pin 11. The end 18 of the hook 6, which lies at 180° of the fulcrum 20 (as regarded about pin 11) will then want to come apart from the pin 11, which is made possible by the spacious curvature of the plane 14*b.* At further pivoting according to C' the hook-shaped end 18 gets more space as a result of the receded plane 15 and finally the situation shown in FIG. 2E is realized, in which the end of the hook as a result of the bevel 13 can move upwards along the pin 11 and away from the support 9. It will be understood that a comparable arrangement can be applied with the hindmost support 10 on the fluke 8, for the hook 7, which will then be pivoted in the direction D.

Figure 2G:
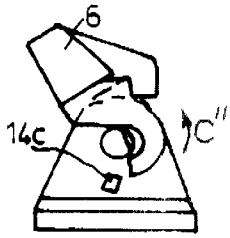
Figure 2F:
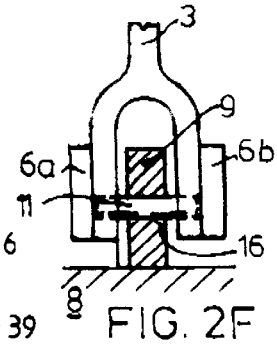

In FIG. 2G a simple alternative for the coupling of the FIGS. 2A–G has been shown. The confinement portion 14*a* is replaced here by confinement cam 14*c* which is welded to the plate 9. The end 18 can pivot along the cam 14*c* to the outside when the fulcrum 20 has been realized.

In the FIGS. 3A–D a so-called shank angle adjuster 31 has been shown, as for instance described in applicant's International patent application therefore. By means of socket 40 at the location of the hinge pin 41, the anchor line 32 is permanently attached to one end of an elongated plate 35, at the other end of which by means of hinge pin 38 a shackle 37 for the hindmost shank wires 34 has been attached. There could be two plates 35, lying next to each other and determining between them a receiving space for a second plate 36, which is hingably connected with the plate 35 at the location of the hinge pin 38 and is provided with a fixed pin 39 reaching up to the inner surface of the plate 35. At the location of the hinge pin 43 the plate 36 is furthermore connected with shackle 42 for foremost shank wires 33.

Special now is that at the lower end the end block 40 is provided with a hook 44, which during installing the anchor, including the shank wires 33, 34, engages the pin 39 as a result of the pulling direction. In this way the plates 35 and 36 are kept together in a folded state. With the pin 39 the hook 44 forms a locking mechanism here which can be uncoupled.

If the anchor line 32 is pulled taut is now pivoted in the direction E, the tension will continue to exist in the foremost shank wires 33 and these will sway along to a more upright position. The plates 35 and 36 will also swing along in a anticlockwise direction. Because of the slackening of the shank wires 34 the anchor line 32 can come in (pulling) line (F) with the foremost shank wires 33. The location of the pin 39 is now such with respect to that pulling line, that the hook 44 has come free from the pin 39, which, for that matter, can be provided with a bevel to advance the moment of release.

Figure 3A:
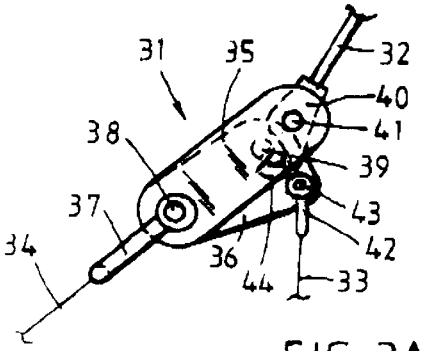
FIGS. 3A–D a shank angle adjustment mechanism which is situated at the upper end of a shank, during consecutive stages.
Figure 3B:
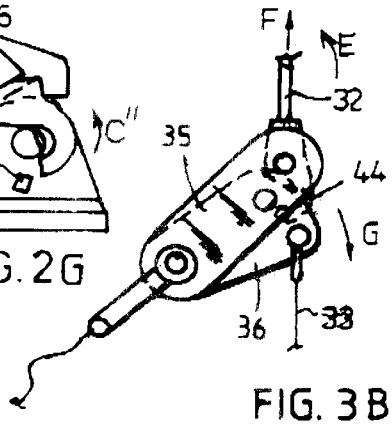
Figure 3C:
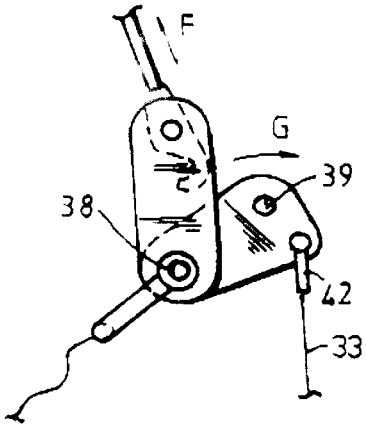
Figure 3D:
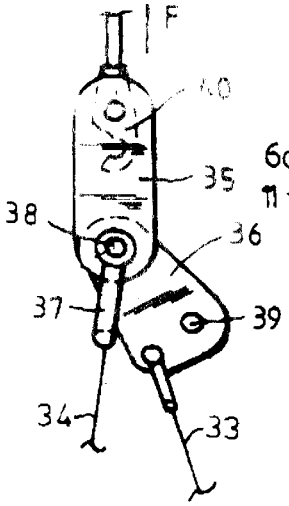

Subsequently the plate 36 can tilt about the hinge pin 38 in the direction G to the situation shown in FIG. 3D, in which the distance between the pivot pin 41 and the shackle 42 has been enlarged and as a result the shank formed by the shank wires 33 and 34 can be arranged at a larger opening angle with respect to the fluke than was the case in the situation in FIG. 3A.

Figure 4A:
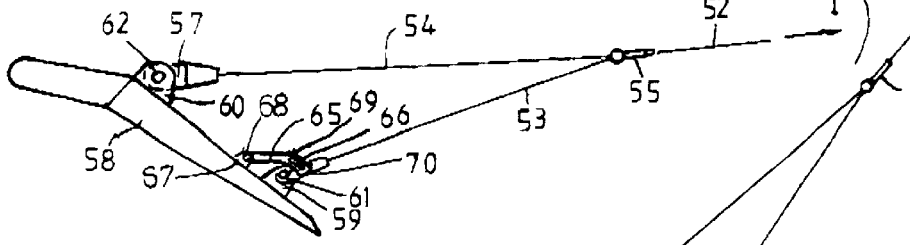
FIGS. 4A, 4B and 4C an alternative shank angle adjustment mechanism in which the coupling according to the invention is included.
Figure 4B:
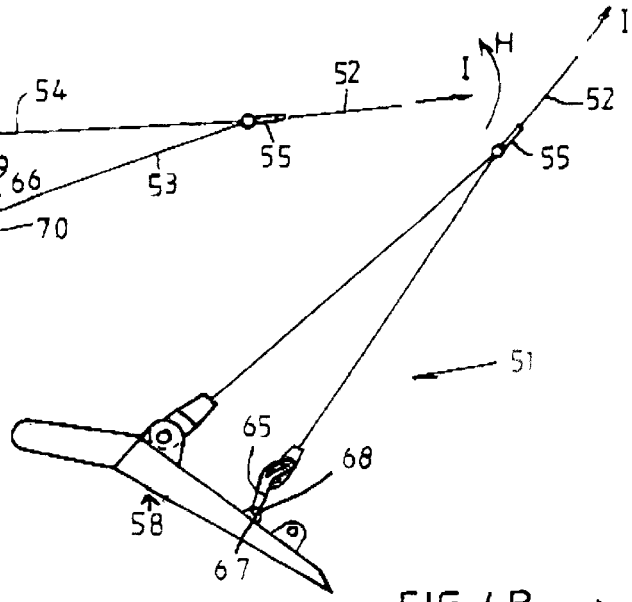
Figure 4C:
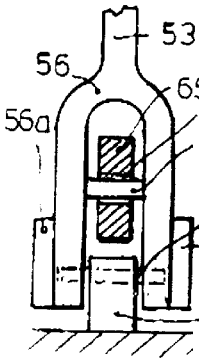
Figure 5A:
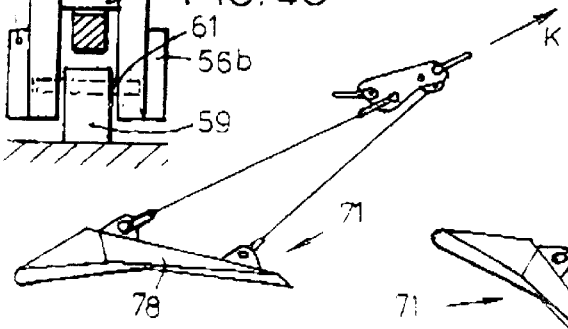
FIGS. 5A–D another exemplary embodiment of the anchor according to the invention, in which the coupling is used to easily haul in the anchor.
Figure 5B:
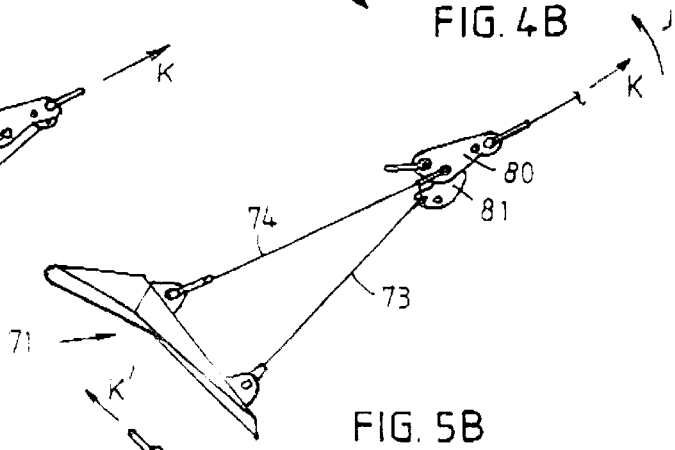
Figure 5C:
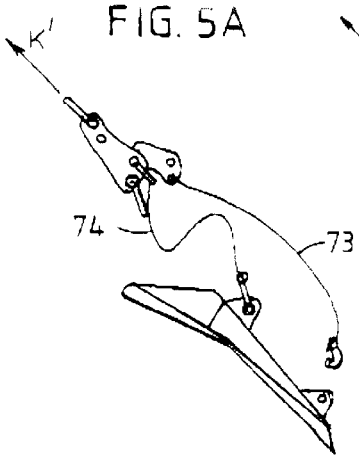
Figure 5D:
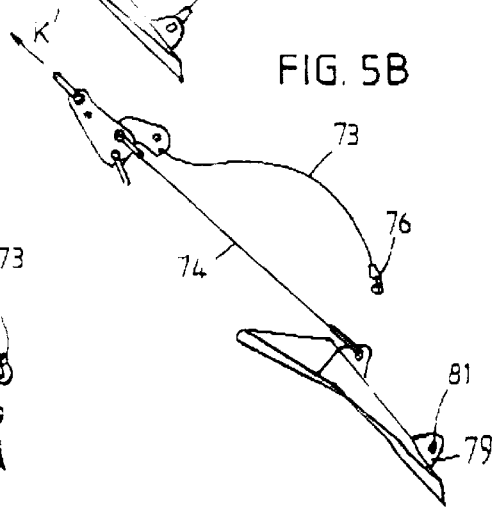

In the FIGS. 4A and 4B the anchor 51 has been provided with a fluke 58 with foremost supports 59 and hindmost supports 60, which have been provided with pins 61 and 62 respectively, all this in accordance with the anchor of the FIGS. 1A–D. By means of shackle 55 the anchor line 52 is connected to the foremost and hindmost, respectively, shank wires 53, 54, the hindmost shank wires 54 being fixedly though hingably by means of end block or socket 57 through pin 62, connected with support 60 on the fluke 58. The foremost shank wires 53, however, are provided with sockets with hooks 56, which may largely correspond with the hook of the FIGS. 2A–E. The same goes for the support 59: it may correspond with support 9.

Special now is that within the sides, the hook 56 is provided with pin 66 which pin is slidably accommodated in slot 70 which has been made in a buckled elongated plate 65, which at the other end at the location of hinge 68 is connected to the support 67 which is fixed to the fluke 58. In the situation shown in FIG. 4A the slot 70 runs according to a curve which is concentric to the central axis of the pin 61. The hook 56 is furthermore provided with two joined side plates 56*a, b,* just like the hook 6 discussed earlier.

When the anchor line 52 is pulled tighter in the direction I and swung in the direction H the hook 56 will pivot along, the pin 66 running to the left in the slot 70. When the pin 66 reaches the end limit 69 of the slot 70 a fulcrum is realized there, which can be compared to fulcrum 20 in the FIGS. 2C–E. With on-going swinging in the direction H the hook 56 is released, but because the pin 66 remains confined in the elongated plate 65 and because of that the hook remaining connected, though indirectly by means of 68, to the fluke 58, the effect will be that the distance along the foremost shank wires 53 between the shackle 55 and the fluke 58 is enlarged, resulting in the shank edge opening to the fore being enlarged. In the case shown in FIG. 4B the anchor 51 can be used for an anchoring system in which pulling perpendicular to the fluke takes place. Instead of the rigid plates 65 a flexible chain or cable can also be used, which has been connected to the hook and the fluke.

In the FIGS. 5A–D yet another example is shown of an anchor 71, which, at the lower end of the foremost shank wires 73, is provided with a shank angle adjuster 80, 81 and a detachable coupling according to the invention. The hindmost shank wires 74 are permanently though hingably connected to the fluke of the anchor. By swinging the anchor line 72 in the direction J and simultaneously pulling in the direction K, K' the hook 76 is released from the pin 81 of the support 79. This construction is comparable to the one of FIGS. 1A–D and 2A–E or 2G.

Figure 6:
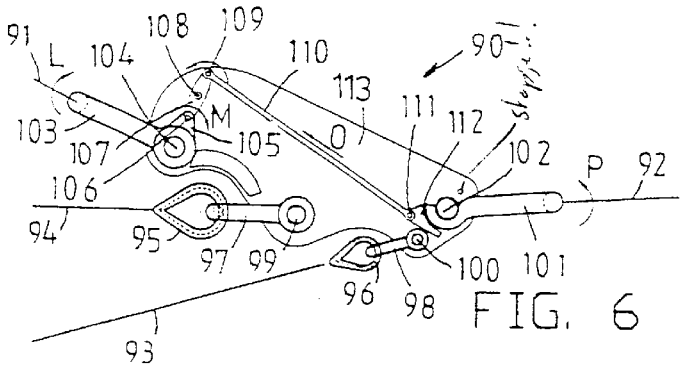
FIG. 6 a detail of a possible embodiment of the coupling in a anchor according to the invention.

In FIG. 6 a connecting device 90 according to the invention has been shown, which can be found at the upper end of the shank, here consisting of foremost and hindmost shank wires 93, 94, respectively. The device 90 comprises one or more parallel plates 113', to which various shackles for various wires or anchor lines have been attached. At the location of the pivot pin 99, the hindmost shank wires 94 are connected to the device 90 by means of eye 95 en shackle 97 whereas the foremost shank wires 93 have been connected to it by means of eye 96 and shackle 98 with hinge pen 100. Furthermore a (vertical) load line 91 has been connected to the device 90 by means of shackle 103 and pivot pin 104. At the other end the installation line 92 has been connected to the device 90 by means of hook 101 and pin 102. The lower end of the hook 101 is kept confined between the pivot pin 102 and wedge 112. This wedge 112 itself is held confined between shackle 98 and hook 101 and is connected to an operating rod 110, at the location of pivot pin 111 which rod is povitably connected to lever 107 at the other end at the location of 109, which lever has been pivotably connected to the device 90 by means of pivot pins 108. By means of pivot pin 106 the other end of the lever 107 is connected to protrusion 105, which has integrally been formed with the shackle 103.

After having the anchor penetrated until in the correct position with the help of the installation line 92, one would want to win back the installation line 92 and tighten the load line 91. When the load line 91, which is also to be regarded as an anchor line, is swung in the direction L the pivot pin 106 will pivot along in the direction M and the pivot pin 109 will counter-pivot in the direction N. As a result of this the rod 110 will slide in the direction O, as a result of which the wedge 112 will be pulled out of the space between the shackle 98 and the hook 101, thus providing downward space for the hook 101. The hook 101 can now become released from the pin 102, for instance by falling downwards or by pulling the line 91 further. The removal can also be promoted by swinging the installation line 92 in the direction P whereby the hook 101 will be rotated in the direction P until abutment against stop pin 120. During continued swinging in the direction P, the pin 120 serves as a pivot point for the hook 101 until this hook is completely free from the pin 102. The installation line 92 can be hauled in after that and the load line 91 be further tightened, also resulting in the position of the pivot pins 99 and 100 being altered and the shank angle being enlarged.

Figure 7A:
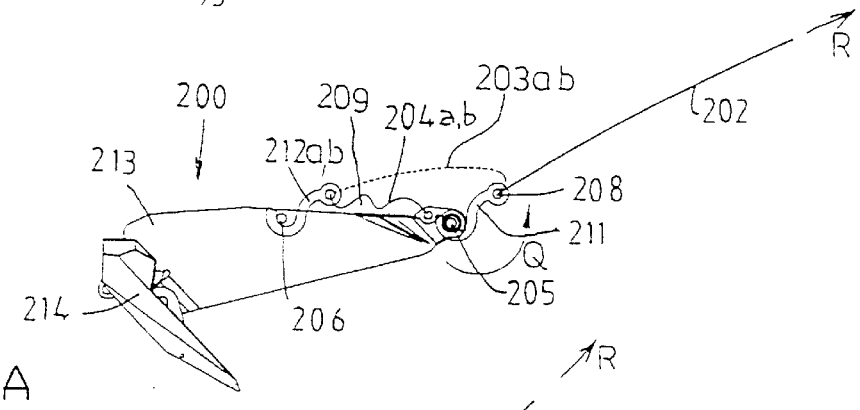
FIGS. 7A–C an anchor according to the invention which is provided with various couplings.
Figure 7B:
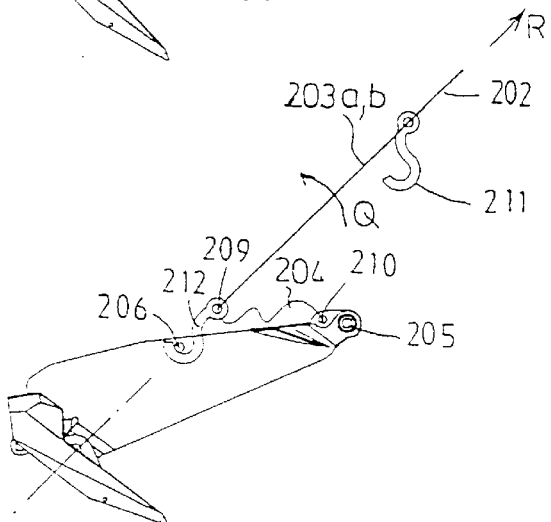
Figure 7C:
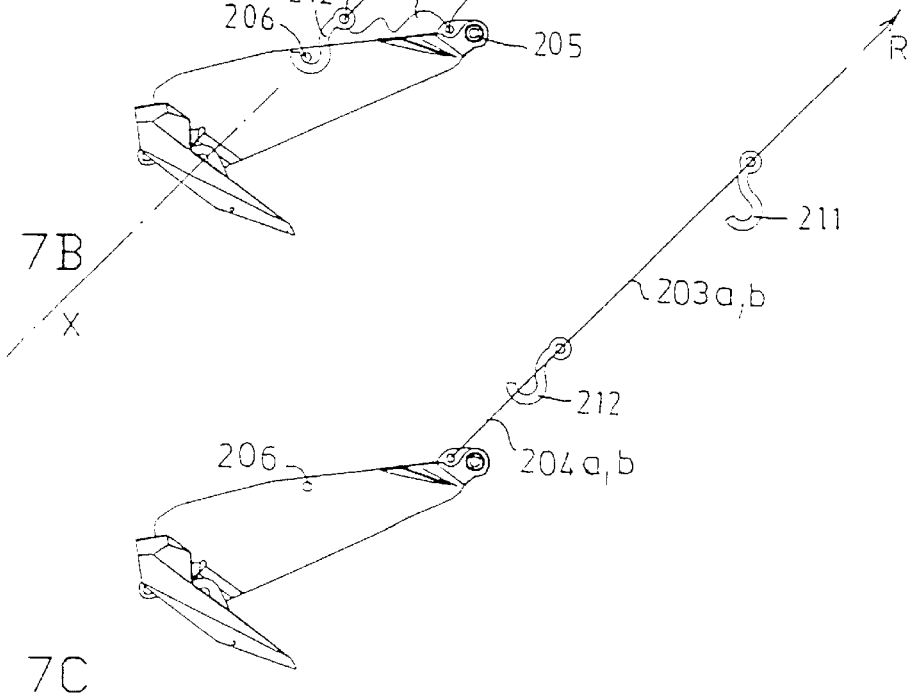

In the FIGS. 7A–C the principle according to the invention is applied in multiple ways. The anchor 200, of the so-called Strevpris type, which type is available with applicant, has a fluke 214 and a rigid shank 213 which consists of two similar plates, in which—as is schematically shown—at half level, a pin is 206 has been attached on both plates, and in which at the upper end the plates are connected to one another by means of pin 205. A hook 211 engages, about the pin 205 which hook has been attached to the anchor line 202, which is used during installation. At the location of 208 the upper end of the hook 211 however is still connected to two extension parts 203*a, b* of the anchor line 102, which extension parts 203 are each connected to a similar hook 212 at the location of 209. These hooks 212 engage about the respective pivot pins 206 in the way described above and are confined in lateral direction. The hooks 212 each are connected to further extension parts 204*a, b* of the anchor line at the location of 209. Finally these extension parts 204*a, b* are connected to the upper end of the shank 213 at the location of 210.

When it is desired to use the anchor after installation in anchoring systems in which pulling substantially perpendicular to the upper surface of the fluke has to take place, the installation line 202 is swung about in the direction Q while exerting pulling forces in the direction R. In the way described before the hook 211 will then, because of the fact that the anchor 200 is kept in position by the ground, pivot about the pin 205 and be released. Then the situation shown in FIG. 7B has been reached, in which the anchor line 202, 203*a, b* has been connected to the anchor 200 by hook 212 and the pin 206. That situation is the situation of use, in which the anchor line 202 almost coincide with the line X which is perpendicular to the surface of the fluke 214 and goes through its surface centre of gravity.

When it is desired to haul in the anchor 200 again, the anchor line 202 is swung further again in the direction Q in order to have the hooks 112 released from the pins 206 in the way described earlier. Then the point of engagement of the anchor line 202, 203*a,* 204*a, b* is moved to point 210 at the top of the shank, and the anchor 200 can be pulled out of the ground with a sufficiently oblique position of the anchor line.

Figure 8:
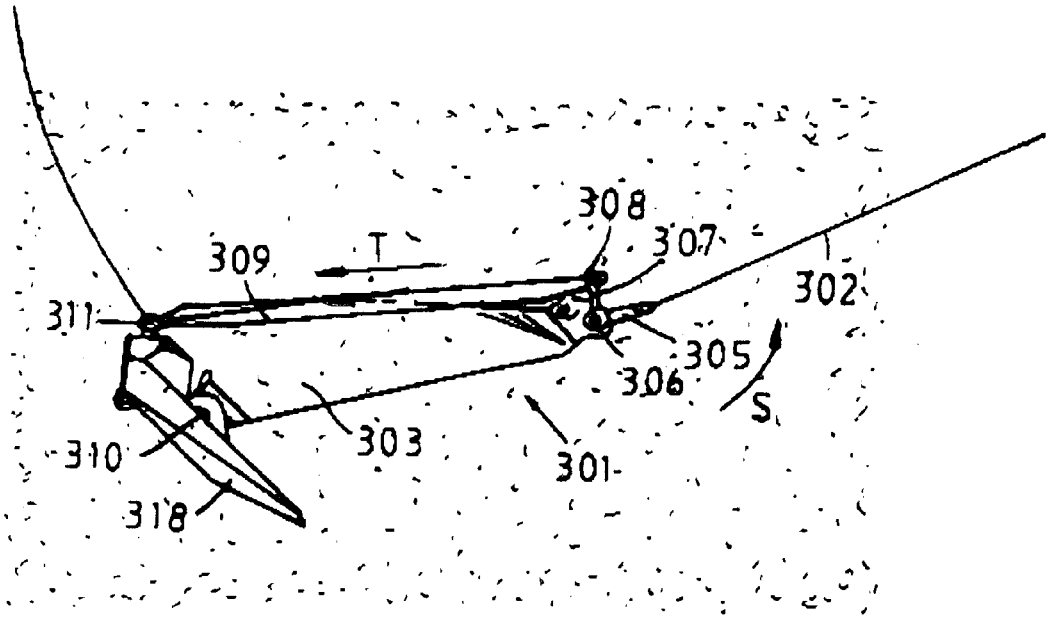
FIG. 8 another example of the anchor according to the invention.

It will be understood that the coupling mechanism according to the invention as well as its operating means can have a multitude of shapes. By way of example, as shown in FIG. 8, in an anchor 301 with a fluke 318 and a rigid shank 303 a lever mechanism can be provided, which extends along the shank to a hindmost point of attachment 311 of the shank on the fluke. The lever mechanism works thus that the swinging in the direction S of the taut anchor line 302 pivots the shackle 305 about pivot pin 306, in which the levers 307 which are fixed with the shackle 305 for pivoting therewith pivot along. The arm 307 is hingably connected to rod 308 by pin 308, which rod slides in the direction T. A coupling, which is not further indicated, is situated at the location of the attachment 311 with which coupling the second coupling member is moved in relation to the fixed first coupling member with the fluke to uncouple it and to release the attachment 311. The shank 303 then remains connected to the fluke 308 with the foremost hinge connection 310.

In many cases the most advantageous approach will be to swing the anchor line in a direction which enlarges the angle with the fluke at uncoupling. It will be understood that it will however also be possible to adapt the coupling such that swinging in the opposite direction is necessary.

What is claimed is:

1. Anchor with a fluke with a longitudinal axis which extends from the rear end of the fluke to its front end and with connection means for connecting the fluke with the lower end of an anchor line, which connecting means comprise an anchor shank, the connecting means comprising at least one coupling with two cooperating coupling members, the first of which being situated on the fluke side of the coupling and being directly or indirectly connected to the fluke in order to follow its movement and the second being situated on the anchor line side of the coupling and being directly or indirectly connected to the anchor line, the anchor furthermore comprising operation means for the coupling which means are activated by swinging the anchor line held taut in order to enlarge its angle with respect to the longitudinal axis of the fluke and then to mutually displace the first and second coupling member from a coupling position to a decoupling position in which the second coupling member is released or emerges from coupling engagement with the first coupling member, the second coupling member comprising a rigid coupling hook which can be released by means of said manipulation of the anchor line, the first coupling member comprising a pin about which the coupling hook rotatingly engages, wherein the coupling hook has a pin receiving hook space its opening facing in the direction of swinging of the anchor line during its movement towards the decoupling position, the operation means being adapted for having the hook pivot about an axis, which is parallel to and at a distance from the pin and located at the side of the pin facing away from the fluke, from the coupling position to a release position.

2. Anchor according to claim 1, the coupling being adapted such that after release from the coupling hook the latter can be entirely lifted away from the pin by pulling the anchor line.

3. Anchor according to claim 1, the operation means being provided with means for urging away the coupling hook from the pin during said swinging movement of the anchor line.

4. Anchor according to claim 1, the operation means comprising a first stopping face which is stationary with respect to the pin at least as long as the coupling hook and the pin are coupled to one another, and comprising a second stopping face on the hook integrated therewith, the first stopping face forming a limitation for the displacement of the second stopping face at pivoting the hook about the pin and therewith forming a fulcrum for the hook.

5. Anchor according to claim 4, the second stopping face being at the most 180 degrees in circumferential direction of the hook spaced from the end of the coupling hook.

6. Anchor according to claim 4, the pin being provided with a flattening at the side of the pin facing away from the hook opening.

7. Anchor according to claim 1, the connection means comprising a second permanent, latently present connection, which connection extends parallel to the coupling formed by the coupling members, and becomes active after releasing the coupling.

8. Anchor according to claim 7, the second connection mentioned being a cable or chain.

9. Anchor according to claim 7, the second connection mentioned being a rigid element which can be extended or folded out.

10. Anchor according to claim 9, the coupling hook being pivotably though permanently attached to an end of an elongated, rigid intermediate member by means of a second pin, which member at the other end by means of a third pin is pivotably connected to a part of the anchor which forms a rigid whole with the pin, which is situated between the second and the third pivot pin in the coupling position.

11. Anchor according to claim 10, the intermediate member comprising a longitudinal slot which is concentrically situated with respect to the pin and in which the second pin is able to slide until abutment, the abutment with the second pin subsequently forming a fulcrum for the coupling hook.

12. Anchor according to claim 10, the second pin being fixedly connected to the intermediate member and the hook pivoting about the second pin at uncoupling.

13. Anchor according to claim 1, wherein said shank has a lower end near the fluke, the pin forming part of the first coupling member being attached to the fluke and the coupling hook forming part of the second coupling member being attached to the lower end of the shank.

14. Anchor according to claim 13, the shank being connected to the fluke with at least a front and rear hinge connection spaced in the direction of the longitudinal axis, at least the front hinge connection being constructed as said coupling.

15. Anchor according to claim 14, the rear hinge connection also being constructed as said coupling.

16. Anchor according to claim 15, the coupling hook forming part of the second coupling member of the front hinge connection being a part of the operation means for the rear hinge connection.

17. Anchor according to claim 13, the operation means comprising a lever mechanism which is pivotably mounted on the anchor and being in contact with a portion of the coupling hook which confines the pin forming part of the first coupling member in order to displace it with respect to said pin for releasing said portion.

18. Anchor according to claim 17, the shank being connected to the fluke with at least a front and rear hinge connections spaced in the direction of the longitudinal axis, at least the rear hinge connection being constructed as said coupling.

19. Anchor according to claim 18, the lever mechanism extending from the rear hinge connection along the shank to an upper end thereof and being connected there for co-rotation with a shackle for an installation line.

20. Anchor according to claim 1, the coupling being situated between the shank and the anchor line.

21. Anchor according to claim 20, the shank being built of elongated elements which extend between the fluke and the anchor line, at least two elongated elements being pivotally attached with their lower ends to the fluke at positions spaced in longitudinal direction and being pivotably attached with their upper ends to a first rigid elongated coupling plate on spaced positions, a second rigid elongated coupling plate being hingably connected at one end of the first coupling plate and at a distance thereof forming the coupling with the first coupling plate.

22. Anchor according to claim 21, the hinge connection between the two coupling plates coinciding with the connection between the rear elongated element and the first coupling plate.

23. Anchor according to claim 20, the shank being provided at the top with a connection for an installation line and of a connection for a mooring or load line, the connection for the installation line being provided with the coupling and the operation means for the coupling being activated by pivoting the load line.

24. Anchor according to claim 23, the operation means comprising a lever mechanism, pivotably arranged on the shank and the first coupling member having a wedge confining the second coupling member being in contact with the lever mechanism in order to be displaced thereby with respect to the second coupling member for its releasing.

25. Anchor according to claim 20, the shank being rigid and the coupling being provided at the upper end of the shank, the anchor line further being connected with the shank on a location between the fluke and the upper end of the shank by means of a latently present extension.

26. Anchor according to claim 25, said location being at least almost perpendicularly located above the surface centre of gravity of the fluke.

27. Anchor according to claim 25, the latently present extension being connected to the shank on said location by means of a second coupling.

28. Anchor according to claim 27, either the anchor line or the extension being connected to the upper end of the shank by means or a second latently present extension.

29. Anchor according to claim 1, the coupling and the operation means being adapted for uncoupling in a non-destructive manner.

30. Anchor according to claim 1, the pivoting of the anchor line for the uncoupling taking place by enlarging the forwardly opening angle between the anchor line and the longitudinal axis of the fluke.

31. Method for uncoupling a coupling or lock in the connection between the fluke of an anchor and an anchor line, said fluke having a longitudinal axis, the anchor line being swung around in a tightened state in a direction with respect to the longitudinal axis of the fluke in which the angle included by the anchor line and the longitudinal axis is enlarged, wherein use is being made of said coupling or lock comprising a rigid hook rotatingly engaging about a pin for coupling, said hook being moved away from said pin in a direction counter to the direction of said swinging movement of said anchor line, thereby inducing the uncoupling.

32. Anchor with a fluke with a longitudinal axis which extends from the rear end of the fluke to its front end and with connection means for connecting the fluke with the lower end of an anchor line, which connecting means comprise an anchor shank, the connecting means comprising at least one coupling with two cooperating coupling members, the first of which being situated on the fluke side of the coupling and being directly or indirectly connected to the fluke in order to follow its movement and the second being situated on the anchor line side of the coupling and being directly or indirectly connected to the anchor line, the anchor furthermore comprising operation means for the coupling which means are activated by swinging the anchor line held taut in order to enlarge its angle with respect to the longitudinal axis of the fluke and then to mutually displace the first and second coupling member from a coupling position to a decoupling position in which the second coupling member is released or emerges from coupling engagement with the first coupling member, the second coupling member comprising a rigid coupling hook which can be released by means of manipulation of the anchor line, the first coupling member comprising a pin about which the coupling hook engages, wherein the coupling hook has a pin receiving hook space, its opening facing in the direction of swinging of the anchor line during its movement towards the decoupling position, the operation means being adapted for having the hook pivot about an axis, which is parallel to and at a distance from the pin, from the coupling position to a release position, wherein said hook and said anchor line are located on either side of said pivot axis.

33. Anchor according to claim 32, wherein the hook rotatingly engages the pin for rotation thereabout.

34. Anchor with a fluke with a longitudinal axis which extends from the rear end of the fluke to its front end and with connection means for connecting the fluke with the lower end of an anchor line, which connecting means comprise an anchor shank, the connecting means comprising at least one coupling with two cooperating coupling members, the first of which being situated on the fluke side of the coupling and being directly or indirectly connected to the fluke in order to follow its movement and the second being situated on the anchor line side of the coupling and being directly or indirectly connected to the anchor line, the anchor furthermore comprising operation means for the coupling which means are activated by swinging the anchor line held taut in order to change its angle with respect to a longitudinal axis of the fluke and then to mutually displace the first and second coupling member from a coupling position to a position in which the second coupling member is released or emerges from coupling engagement with the first coupling member, the second coupling member comprising a rigid coupling hook which can be released by means of manipulation of the anchor line, the first coupling member comprising a pin about which the coupling hook engages, the operation means being adapted for having the rigid hook pivot about an axis, which is parallel to and at a distance from the pin, from the coupling position to a release position.

* * * * *